US005134794A

United States Patent [19]

Walrath

[11] Patent Number: 5,134,794

[45] Date of Patent: Aug. 4, 1992

[54] SIGN HOLDER WITH LOCATING MEANS FOR PERMANENT GRAPHICS PANEL

[75] Inventor: John E. Walrath, Pewaukee, Wis.

[73] Assignee: Process Displays, Inc., New Berlin, Wis.

[21] Appl. No.: 648,088

[22] Filed: Jan. 31, 1991

[51] Int. Cl.[5] ..... A47G 1/06; G09F 1/10

[52] U.S. Cl. ..... 40/152.1; 40/152

[58] Field of Search ..... 40/152, 152.1, 156, 40/611, 155

[56] References Cited

U.S. PATENT DOCUMENTS

| | | | |
|---|---|---|---|
| 2,959,882 | 11/1960 | Krull | 40/152 |
| 3,242,605 | 3/1966 | Kleinschmidt | 40/152 |
| 4,777,750 | 1/1988 | Garfinkle | 40/152.1 |
| 4,989,353 | 2/1991 | Astofi | 40/152.1 |

*Primary Examiner*—Kenneth J. Dorner
*Assistant Examiner*—Cassandra L. Hope
*Attorney, Agent, or Firm*—Quarles & Brady

[57] ABSTRACT

A sign holder including a permanent graphics panel held in a frame formed of two molded plastic frame-halves joined together and which include elements that locate the permanent graphics panel relative to the frame.

10 Claims, 4 Drawing Sheets

Fig. 9
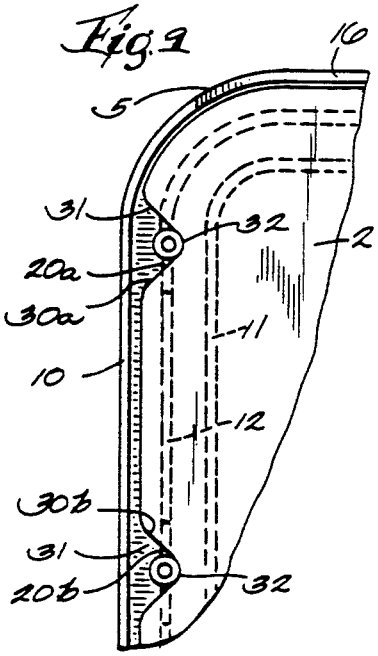
Fig. 10
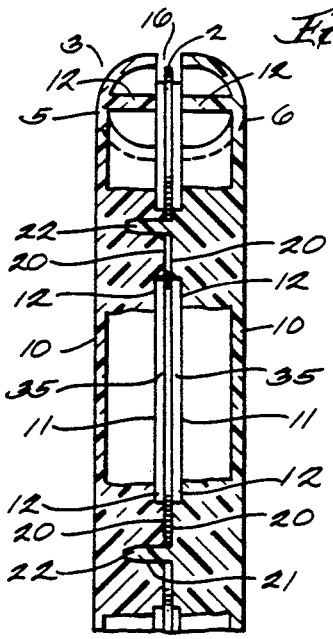
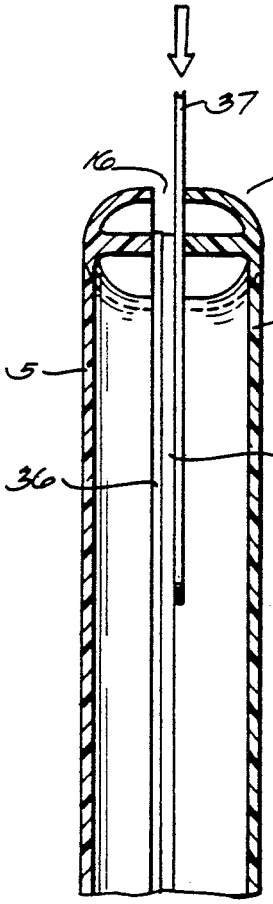
Fig. 11

SIGN HOLDER WITH LOCATING MEANS FOR PERMANENT GRAPHICS PANEL

FIELD OF THE INVENTION

The present invention relates to the signage and graphics art, more particularly to the art of supporting sign members in a holder for displays such as point of purchase displays and other types of advertising or informational displays.

BACKGROUND OF THE INVENTION

The present invention was developed to meet what I consider to be an unfulfilled need in the field of sign holders of the type that have a frame for supporting one or more graphics panels or signs. Sign holders of this type are often used as point of purchase displays to provide a construction that can accommodate both permanent graphics panels and changeable or temporary signs. For example, convenience stores, service stations or other similar types of businesses may want to display a sign holder that carries advertising by a national company but also includes a temporary sign advertising a local, specific or short term promotion. The prior art constructions that are meant for this type of end use have been made of metal channel sections, but this imposes restrictions on the kind of sign holder that can be made and results in sign holders of limited functionality, in addition to which the sign holders generally are of fairly high cost and relatively unattractive appearance.

One of the objectives of the present invention was to develop a new frame construction for holding a permanent graphics panel and one or two changeable or temporary signs. Another principal object was to provide a new frame construction in which a permanent graphics panel can be mounted and held in place without being removable in the field. A further principal objective of the invention was to provide a frame of the foregoing construction for holding a permanent graphics panel wherein the frame can be adapted to retain the graphics panel along either the centerline of a slot or offset to one side of the slot but in which a minimum of parts would be necessary in order to accommodate either arrangement of the permanent graphics panel. Still another principal objective of my present invention was to provide a frame for holding signs having the foregoing characteristics wherein the frame components can be manufactured of injection molded plastic so a to thereby provide a frame that can be made economically and also made in an attractive appearance. These and other more specific objects will become apparent in the detailed description which follows.

SUMMARY OF THE INVENTION

My present invention provides a frame for holding sign panels consisting of two frame-halves that are joined together in such fashion as to hold a graphics panel permanently in the frame. Further, a central slot is formed along the frame when two frame-halfs are joined together, and the frame-halfs include structural elements that locate the permanent graphics panel along either the centerline of the slot, in which case changeable signs can be inserted in the slot along both sides of the permanent graphics panel or offset from the centerline along one side of the slot, in which case a single changeable sign can be located along one side of the permanent graphics panel. Still further, the two frame-halfs are molded of plastic so that their various structural elements can be formed as integral parts of a one piece frame-half.

DESCRIPTION OF THE DRAWINGS

The ensuing detailed description of sign holders according to the invention is made by reference to the accompanying drawings which illustrate two presently-preferred sign holder constructions, in which:

FIG. 9 is a plan view, with portions broken away, of a permanent graphics panel inserted on the frame-half of FIGS. 3–8;

FIG. 10 is a sectional view, with portions broken away, illustrating the right hand side of the sign holder of FIG. 1;

FIG. 11 is a view similar to FIG. 10 illustrating the addition of changeable sign panels to the sign holder;

DESCRIPTION OF PRESENTLY-PREFERRED EMBODIMENTS

FIGS. 1–18 illustrate several examples of a sign holder according to the present invention. FIGS. 1–11 depict my new sign holder including a permanent graphics panel located along the centerline of the frame and FIGS. 12–18 show the new sign holder with a permanent graphics panel offset from the centerline of the frame.

(a) Sign Holder With Centered Graphics Panel, FIGS. 1–11

Figure 1:
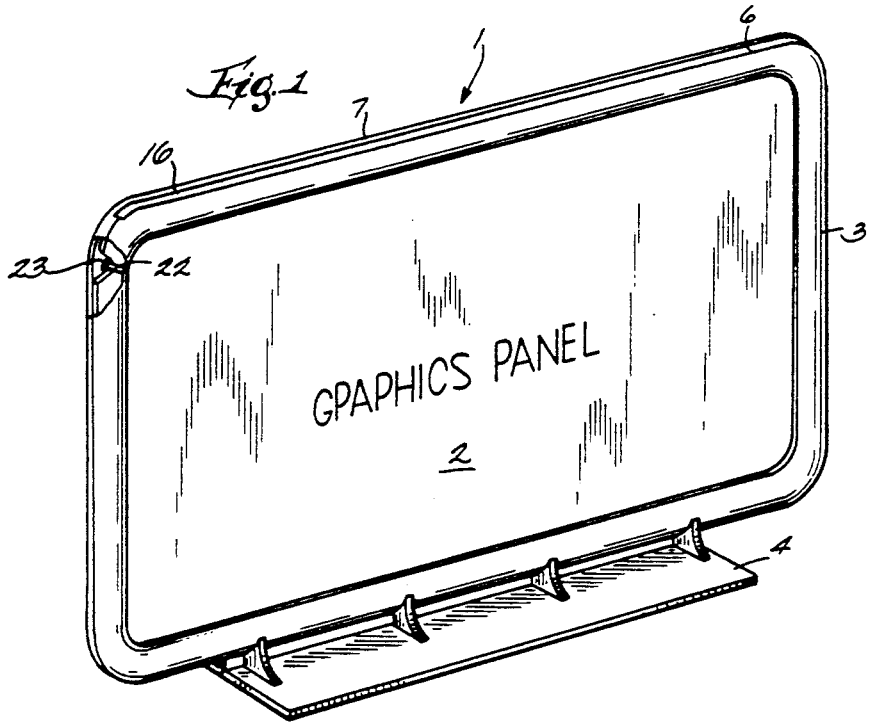
FIG. 1 is a perspective view of a first sign holder of the invention.

FIG. 1 illustrates a sign holder 1 of the invention including a permanent graphics panel 2 positioned along the centerline of the holder. Sign holder 1 comprises a rectangular frame 3, preferably having rounded corners as illustrated although the frame also may have square corners, and a base 4. The base is optional and is used when the holder is to stand on top of a counter, gasoline pump, or other horizontal or vertical surface. The sign holder also can be made without the base if it is to be suspended from the ceiling or hung on a wall.

Sign holder 1 consists of two identical frame-halfs 5 and 6 (FIG. 2) which are joined together as described below to form the holder. When the sign holder includes a base 4, each frame-half 5 and 6 is molded as a single piece structure including a base-half 4*a* as an integral element.

The structure of frame-half 5 is now described in detail by reference to FIGS. 2–8, it being understood that frame-half 6 has the same structure. Frame-half 5 is molded to have a generally U-shaped cross section including (FIGS. 5–8) a peripheral outer wall 10, a peripheral inner wall 11 and an internal wall 12 extending about the frame-half between walls 10 and 11. Frame-half 5 has a generally U-shaped section having a contiguous exterior wall 5', defined by outer wall 10 and inner wall 11, and an open side 5" (see FIGS. 5–8). The exterior wall may be curved as shown in the drawings or straight if a rectangular or square section for frame 3 is desired. Along sides 5*a* and 5*b* and bottom 5*c* of frame-half 5 (see FIG. 2), the outer wall 10 is slightly higher than inner wall 11 and internal wall 12 at open side 5" of the frame-half, whereas inner wall 11 and interior wall 12 are of equal height, all as best shown in the sectional view of FIG. 5. Thus, end surface 13 of outer wall 10 extends a predetermined distance "X" beyond end surface 14 of inner wall 11 and end surface 15 of internal wall 12, end surfaces 13–15 being along open side 5" of the frame-half section. When frame halves 5 and 6 are joined together, as described later, the end surfaces 13 of the outer walls of the two frame-halves will contact each other along the centerline around the outside of frame 3. However, end surfaces 14 of the inner walls 11 of the two frame-halves will be spaced apart a predetermined distance equal to "2X" from one another around the inside of frame 3 so as to accommodate the thickness of the sign panels to be inserted in the frame; end surfaces 15 of the internal walls 12 of both frame halves are similarly spaced from one another for the same reason except for certain elements along each internal wall as described later.

Along the top 5*d* of frame 3, the outer wall 10, inner wall 11 and internal wall 12 are all of the same height. Thus, referring now to the sectional view of FIG. 6, end surface 13*a* of outer wall 10 along top 5*d* is coplanar with end surfaces 14 and 15 of walls 11 and 12, respectively, along the top 5*d* of the frame at the open side 5" of the frame-half. With this construction a slot 16 (FIG. 1) is defined along top 5*d* of the frame when the frame-halves 5 and 6 are joined together. The slot 16 is provided to permit changeable sign panels to be inserted into the frame along each side of the centered permanent graphics panel 2.

Figure 2:
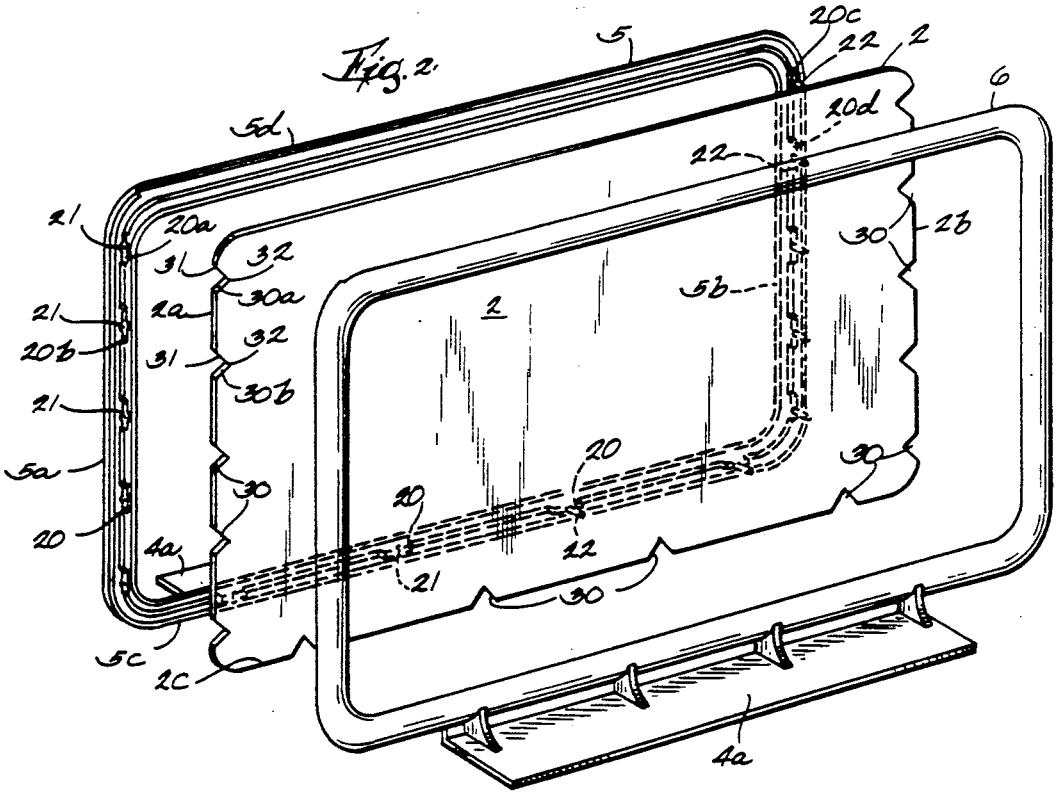
FIG. 2 is an exploded view of the sign holder of FIG. 1.

The manner in which frame-halves 5 and 6 are joined together will now be described. As shown in FIG. 2, a plurality of raised lands 20 are formed as integral sections of internal wall 12 and extend a predetermined distance from wall 12. Lands 20 are equally spaced along sides 5*a* and 5*b* and bottom 5*c* of frame-halves 5 and 6. Some of the lands 20 (preferably one-half of them) include a central socket 21 as illustrated by lands 20*a* and 20*b* in FIG. 2. Other lands (preferably one-half of them) include a locking pin 22 that projects from the land as shown by lands 20*c* and 20*d* in FIG. 2.

Figure 3:
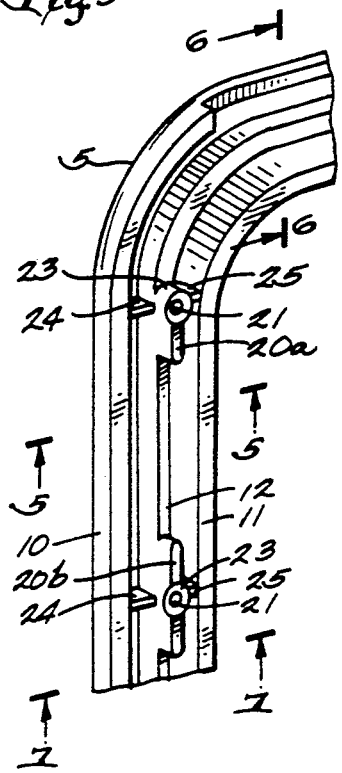
FIG. 3 is a perspective view, with portions broken away, of a frame-half of the sign holder.
Figure 7:
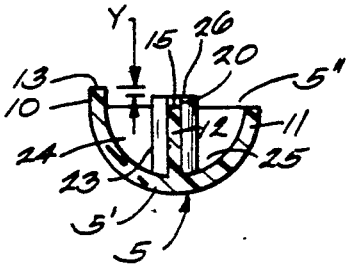
FIG. 7 is a sectional view along the plane of line 7—7 of FIG. 3.

Structural detail of lands 20 that include a socket 21 are best visible in the partial perspective view of FIG. 3 and the sectional view of FIG. 7. Referring first to FIG. 3, lands 20*a* and 20*b* each include a central cylindrical boss 23, and socket 21 is formed as a cylindrical aperture extending partway into a boss 23. Reinforcing web 24 extends between a boss 23 and outer wall 10 of the frame and reinforcing web 25 extends between a boss 23 and inner wall 11 of the frame. Turning now to FIG. 7, end surface 13 of outer wall 10 extends a predetermined distance "Y" beyond end surface 26 of each land 20.

Figure 4:
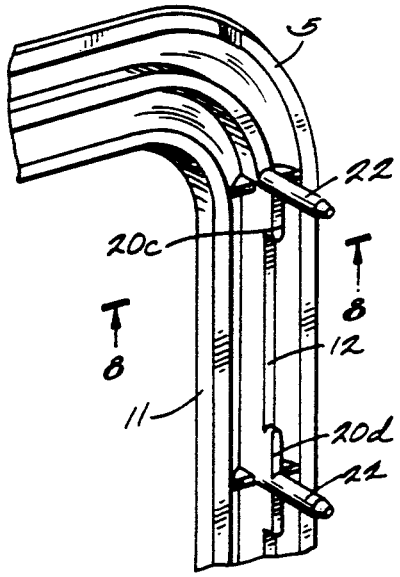
FIG. 4 is a perspective view, with portions broken away, of another portion of the frame-half of FIG. 3.
Figure 8:
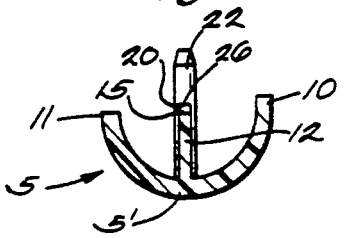
FIG. 8 is a sectional view along the plane of line 8—8 of FIG. 4.
Figure 12:
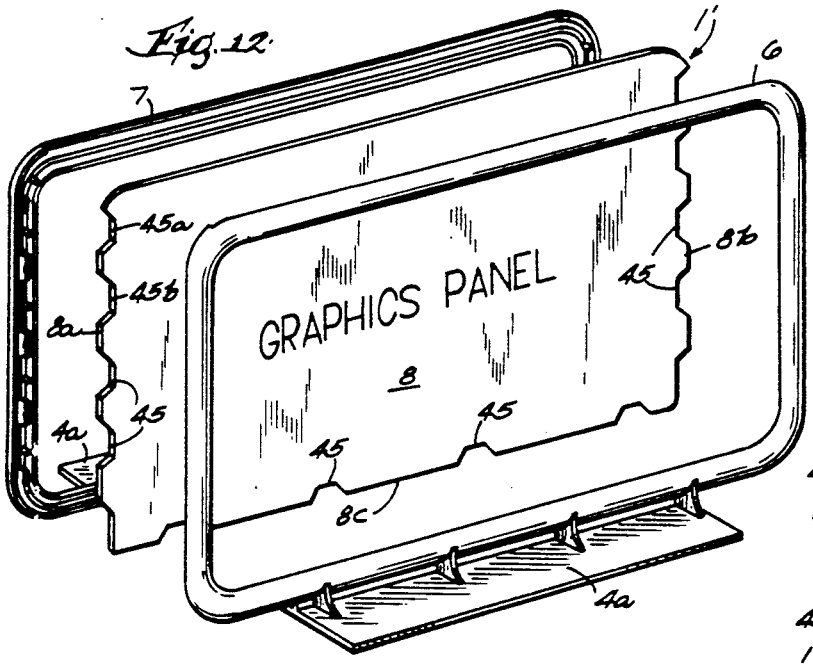
FIG. 12 is an exploded view of a second sign holder of the present invention.

FIGS. 4 and 8 illustrate details of the lands 20 that include a locking pin 22, such as lands 20*c* and 20*d*. Each locking pin 22 projects beyond a land 20 a selected distance related to the depth of socket 21 in the other lands 20. Since frame-halves 5 and 6 are identical, there will be the same number of lands 20 in both halves and the lands of one frame-half will be in line with, or registered with, the lands of the other frame-half when the two are mated together. The sockets 21 and locking pins 22 form the female and male members, respectively, of a locking means for joining frame-half 5 and frame-half 6 together. In the described specific version of the locking means, a locking pin 22 of a land of one frame-half is pressed into a socket 21 of a land of the other frame-half registered therewith, either manually or mechanically, so as to securely join frame-half 5 and frame-half 6 together to form the frame 3. It should be noted, however, that the two frame-halves are not joined together until after permanent graphics panel 2 is positioned between them as described below.

As shown in FIGS. 3 and 4, a land 20 may extend from both sides of a socket 21 or locking pin 22 as in the case of lands 20*b* and 20*d*, or a land may extend from only one side of a socket 21 or locking pin 22 as in the case of lands 20*a* and 20*c* which are located along rounded corners of a frame-half.

FIG. 2 illustrates the structure of permanent graphics panel 2 which is specifically configured to fit in frame 3 in such fashion as to be positioned along the centerline of slot 35 of the frame. Panel 2 includes a series of equally spaced notches 30 along its sides 2*a*, 2*b* and bottom 2*c*. There is one notch 30 along graphics panel 2 for each land 20 along the internal wall 12 of frame-halves 5 and 6, with a notch 30 positioned to be in registry with each land 20. Each notch 30 has an open outer end 31 along the marginal edge of sides 2*a*–2*c* of the panel and a closed inner end 32, see notches 30*a* and 30*b*. A notch 30 is sized appropriately so as to clear or extend around the socket 21 and locking pin 22 at each pair of registered lands 20 when frame-halves 5 and 6 are joined together; however, open end 31 of a notch is narrow enough such that marginal portions of the panel 2 alongside a notch 30 are along each land 20 when frame-halves 5 and 6 are joined together as shown in FIG. 9.

To install a permanent graphics panel 2 in frame 3, panel 2 is first placed on one frame-half 5 or 6 with its notches 30 properly aligned with the lands 20 of the frame-half. This relationship is best illustrated in FIG. 9. Next, the other frame-half is brought into alignment therewith and its lands 20 are registered with the lands 20 of the said one frame-half. Thereafter, the locking pins 22 of the frame-halves are fully seated in the sockets 21 registered with the pins so as to thereby firmly join the two frame-halves together with permanent graphics panel 2 locked in position between the two frame halves. FIG. 10 illustrates the right hand side of the frame as seen in FIG. 1 in partial cross section after the assembly operation has been completed. Frame-halves 5 and 6 are securely joined together and permanent graphics panel 2 is held in place between the two frame-halves. Notches 30 of the panel surround the locking pins 22 of frame-half 6 and the portions of the panel 2 bordering the notches rest on registered lands 20 of the two frame-halves. End surfaces 13 of the outer walls 10 of the two frame-halves are in contact or substantial contact with each other around the exterior of sides 5*a*, 5*b* and 5*c* of the frame. The end surfaces 14 of the inner walls 11 of the two frame halves are spaced from each other along the interior of the frame so as to form an inner slot 35 that extends along sides 5*a*, 5*b* and bottom 5*c* of the frame 3, and panel 2 is centered within slot 35. Slot 16 along the top 5*d* of frame 5 is in communication with slot 35. This construction thereby provides a space or slot along each side of graphics panel 2 into which a changeable sign panel can be inserted. This combination is illustrated in FIG. 11 showing permanent graphics panel 2 along the centerline of frame 3, changeable sign panel 36 inserted along one side of panel 2, and changeable sign panel 37 in the process of being inserted in the frame along the opposite side of panel 2.

As set out above, permanent graphics panel 2 is to be located along the centerline of frame 3 when frame-halves 5 and 6 are joined together. This centered location of panel 2 is achieved by selecting the distance "Y" between end surface 13 of the outer wall 10 of each frame-half and the end surface 26 of the lands 20 formed along the interior wall 12 of each frame-half. Marginal portions of panel 2 around each notch 30 of the panel rest on the lands 20 of each frame-half, and the end surfaces 26 of the lands 20 of each frame-half are to be spaced apart when the two frame-halves are joined together a sufficient distance to accommodate the thickness of a panel 2. Referring again to FIG. 7, the distance "Y" between end surface 26 of a land 20 and end surface 13 of outer wall 10 of each frame-half is selected such that 2Y is at least equal to the thickness of a graphics panel to be inserted in the frame, preferably slightly greater than the thickness of the panel. Thus, end surfaces 26 of the lands provide panel-locating surfaces to position graphics panel 2 along the centerline of the frame.

Figure 5:
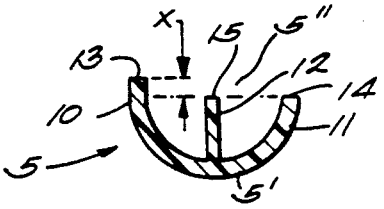
FIG. 5 is a sectional view along the plane of line 5—5 of FIG. 3.
Figure 6:
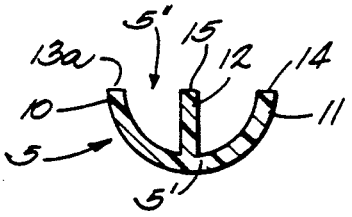
FIG. 6 is a sectional view along the plane of line 6—6 of FIG. 3.

Further, the distance "X" between end surface 15 of internal wall 12 of each frame-half and end surface 13 of the outer wall 10 of each frame-half, referring now to FIG. 5, is selected so as to provide a slot 35 of sufficient width to accommodate changeable sign panels 36 and 37 which may be inserted along each side of permanent graphics panel 2. The distance "X" is selected such that 2X is at least equal to the total thickness of permanent graphics panel 2, changeable sign panel 36 and changeable sign panel 37. This will thereby provide sufficient space within slot 35 on each side of panel 2 to accommodate changeable panels 36 and 37.

As an example of the foregoing, a permanent graphics panel 2 may be made of relatively thick plastic material that is printed on both sides with selected graphics, such as a panel 2 of plastic sheet 0.040" thick. The changeable sign panels 36 and 37 may be of a lighter weight material, such as plastic or paper about 0.020" thick, since they often are changed frequently and may be considered temporary graphics panels. With using a permanent graphics panel 2 and changeable sign panels 36 and 37 of these thicknesses, therefore, the distance "Y" should be at least equal to 0.020" and the distance "X" should be at least equal to 0.040", or slightly more.

Lands 20 are illustrated in the specific embodiment of FIGS. 1–11 as comprising elongated areas extending along internal wall 12. However, other constructions can be employed to provide panel locating means, such as round pin-like elements, solid elements extending between the inner and outer walls of the frame, and elements that extend transversely across internal wall 12 instead of longitudinally along the wall as is the case with lands 20. Whatever specific construction is utilized, lands 20 or other equivalent elements are to provide locating means about the interior of each frame-half along which permanent graphics panel 2 is to be supported so as to be positioned along the centerline of the slot in frame 3.

As noted above, graphics panel 2 is permanently positioned within frame 3 of the sign holder. FIG. 9 illustrates the manner in which this is accomplished. Permanent graphics panel 2 is of such length and height that its marginal portions extend across internal wall 12 and close to outer wall 10 of each frame half. The notches 30 along the two sides and bottom of panel 2 extend outwardly of sockets 21 and pins 22 which thereby prevents panel 2 from being withdrawn from the frame. Panel 2 can only be removed from the frame by prying apart the two frame halfs 5 and 6, but this is prevented by designing sockets 21 and locking pins 22 so as to provide a tight mechanical fit between the locking means. Also, if desired, an appropriate adhesive, such as an epoxy or polyester, or a solvent can be applied to secure the locking pins in the sockets.

(b) Sign Holder with Offset Graphics Panel, FIGS. 12–18

A second sign holder 1′ of the present invention is illustrated in FIGS. 12–18. Structural elements of sign holder 1′ that are the same as corresponding elements of sign holder 1 of FIGS. 1–11 are identified by the same reference numerals used in the description of part (a).

Sign holder 1′ includes a permanent graphics panel 8 that is positioned within frame 3 offset from the centerline of the frame. Sign holder 1′ comprises frame-half 6 and frame-half 7 that form a rectangular frame 3 when joined together.

Frame-half 6 of the sign holder 1′ is of the same construction as frame-halfs 5 and 6 described part (a) in connection with the embodiment of FIGS. 1–11.

Referring now to FIGS. 13–16, it will be noted that frame-half 7 includes all the elements of frame-half 5 described in part (a). In addition, however, frame-half 7 includes a plurality of off center locating elements, illustrated in FIGS. 13–16 as comprising locating pins 40 that extend from internal wall 12 of the frame-half. There are a plurality of spaced locating pins 40 extending about the two sides and bottom of frame-half 7, preferably evenly spaced along internal wall 12. Each locating pin 40 is a cylindrical element molded as an integral portion of the internal wall 12 of frame-half 7.

Figure 14:
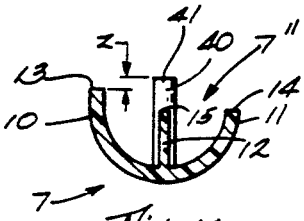
FIG. 14 is a sectional view along the plane of line 14—14 of FIG. 13.
Figure 16:
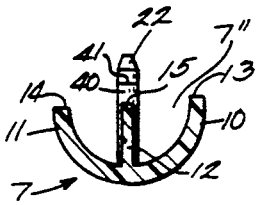
FIG. 16 is a sectional view along the plane of line 16—16 of FIG. 15.

Referring to FIG. 14, each locating pin 40 has an inner end surface 41 that extends a distance "Z" beyond end surface 13 of outer wall 10 of frame-half 7 along open side 7″ of the frame-half. As shown in FIG. 16, a locating pin 40 extends beyond internal wall 12 but in a lesser amount than a locking pin 22.

Figure 17:
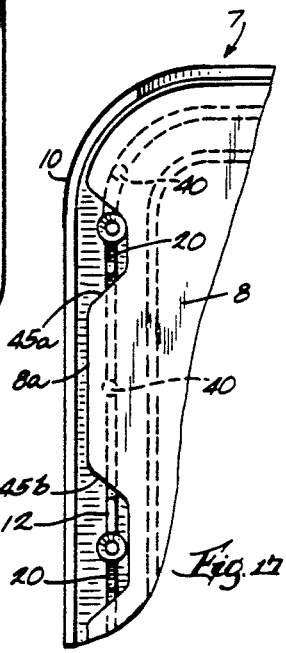
FIG. 17 is a plan view illustrating a portion of the sign holder of FIG. 12.
Figure 13:
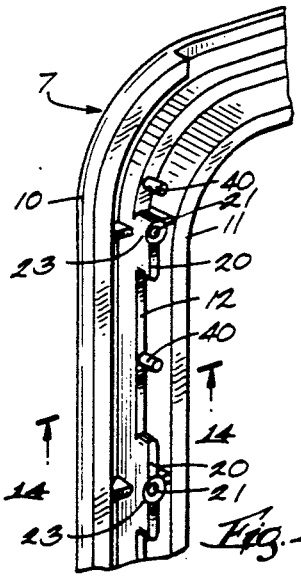
FIG. 13 is a perspective view, with portions broken away, of one frame-half of the sign holder of FIG. 12.
Figure 15:
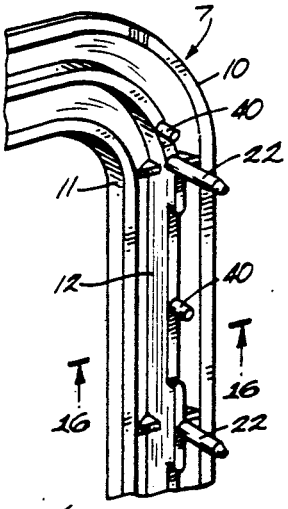
FIG. 15 is a perspective view with portions broken away, of another portion of the frame-half of FIG. 13.

Returning to FIG. 12, graphics panel 8 includes a plurality of trapezoidal notches 45 along its sides 8*a*, 8*b* and bottom 8*c*. The purpose of notches 45 is illustrated in FIG. 17 with reference to notches 45*a* and 45*b*. Notches 45 are sized such that they extend around the lands 20 formed along internal wall 12 of frame-half 7. Consequently, when permanent graphics 8 is positioned on frame-half 7, no part of sign panel 8 contacts a land 20. That is, the lands 20 are not employed as centerline locating means in sign holder 1'. Instead, marginal portions of panel 8 rest on top of the locating pins 40 when the panel is positioned in frame-half 7.

Figure 18:
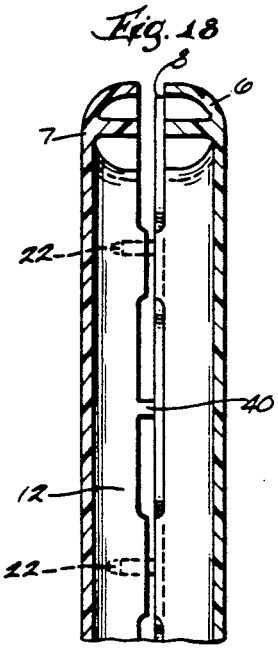
FIG. 18 is a sectional view with portions broken away, of the sign holder of FIG. 12.

After permanent graphics panel 8 is positioned on frame-half 7, frame-halves 6 and 7 are joined together in the same manner as described in part (a) and the assembled condition is illustrated in FIG. 18. In this second embodiment, permanent graphics panel 8 is located along one side of slot 35 between the frame halves 6 and 7 and is shown in the drawing as contacting inner portions of frame-half 6. This arrangement of panel 8 within the frame is obtained by providing locating elements 40 having an end surface 41 that extends the selected distance Z beyond end surface 13 of outer wall 10 of frame-half 7 and wherein the distances X and Z of the frame-half are selected such that 2X — Z is equal to the thickness of permanent graphics panel 8; the distance 2X — Z should be at least equal to the thickness of the graphics panel 8, most usefully the thickness of panel 8. Elements 40 thereby provide second panel locating means adapted to position graphics panel 8 offset from the centerline of frame 3, or along one side of slot 35.

Sign holder 1' is thus adapted to allow inserting a single changeable sign panel along only one side of permanent graphics panel 8. A changeable sign panel such as panels 36 and 37 illustrated in part (a) would be inserted within slot 35 along the left hand side of panel 8 as seen in FIG. 18. The distance X, therefore, can be selected such that 2X is at least equal to the thickness of permanent graphics panel 8 plus the thickness of a changeable sign panel to be inserted in sign holder 1'. Sign holder 1' is useful when it is desired to display both a permanent graphics panel and a changeable or temporary sign.

The two sign holders described above as examples of the present invention each have a four-sided rectangular frame that holds the various panels, but the frame can be made in other configurations, such as a square, triangular or round frame. The sign holders also are illustrated as holding a permanent graphics panel and either one changeable sign as in sign holder 1' or two changeable signs as in sign holder 1; however, it will be apparent to those skilled in the art that the sign holder also can be designed to include only a permanent graphics panel, i.e. without room for changeable signs, if desired for a specific installation. These and other modifications of the structures of the specific sign holders described herein are intended to be in accordance with the present invention as defined in the claims.

There has thus been described a new sign holder adapted for holding a permanent graphics panel and one or a pair of changeable sign panels. The sign holders of the invention are made with two frame-halfs molded of suitable plastic material such as, but not limited to, acrylonitrile butadiene styrene (ABS), acrylonitrile styrene acrylate (ASA) or a blend of ASA and polybutylene terephthlate. This enables the several structural elements of each frame-half to be formed as integral elements of a one piece part. In the first embodiment described above, the two frame-halfs are of identical structure and include centerline panel locating means of a size and arrangement to locate or position a permanent graphics panel along the centerline of a slot in the frame. In the second embodiment of the new sign holder, sign holder 1', one frame-half is of the same construction and the other frame-half has the same elements but further includes offset, or off-center, panel locating means of a size and arrangement to locate or position a permanent graphics panel along one side of the slot formed between the two frame halfs. These new sign holder constructions provide several advantages. For example, it is possible to mold the frame-halfs for both embodiments with only a single mold, to which is added temporary elements to form the off-center locating elements when the second type of sign holder is to be made. Also, the sign manufacturer needs to inventory only two different frame-halfs and yet can provide sign holders having either a centered permanent graphics panel or an offset permanent graphics panel.

Two specific constructions of a sign holder according to the present invention have been described above which represent currently-preferred embodiments of the present invention. However, it is anticipated that those skilled in the art can devise changes to the specific sign holders described herein that will remain within the scope of the appended claims and their appropriate equivalents.

I claim:

1. A sign holder comprising, in combination:

(1) a first frame-half of molded plastic including (a) a peripheral outer wall and a peripheral inner wall defining a frame-half having a generally U-shaped section with a contiguous exterior wall and an open side, (b) an internal wall extending about the frame-half between the outer wall and the inner wall, (c) the outer wall, inner wall and internal wall each including an end surface along the open side of the frame-half, (d) a plurality of spaced first panel locating means along the internal wall, each having a panel-locating surface extending beyond the end surface of the internal wall, with (i) some of the locating means including a socket, and (ii) other of the locating means including a locking pin extending therefrom;

(2) a second frame-half of the same structure as the first frame-half;

(3) a permanent graphics panel between the first frame-half and second frame-half jointed together with locking pins of one frame-half retained in sockets of the other frame-half registered therewith and with the first panel locating means of the two frame-halfs locating the permanent graphics panel along a centerline of the frame.

2. A sign holder according to claim 1, wherein:

the panel locating means comprises a plurality of spaced lands along the internal wall of each frame-half, each land has a panel-locating surface extending beyond the end surface of the internal wall, and the sockets and locking pins are formed along the lands.

3. A sign holder according to claim 1, wherein:

each frame-half includes a base-half as an integral element thereof, and the two base-halfs define a base for supporting the sign holder with the two frame-halfs joined together.

4. A sign holder according to claim 1, wherein:

the permanent graphics panel includes marginal portions that surround the locking pin and socket of each locating means and are positioned along the panel-locating surface of each panel locating means.

5. A sign holder according to claim 1, wherein:

each frame-half has four sides, the end surface of the outer wall of each frame-half extends a selected distance X beyond the end surface of the inner and internal walls along three sides of the sign holder and is coplanar therewith along a fourth side, the end surface of the outer wall of each frame-half extends a selected distance Y beyond the panel-locating surface of each panel locating means along said three sides, distance X being greater than distance Y, the sign holder with the first and second frame-halves joined together includes a peripheral inner slot between the inner wall and the internal wall of each frame-half along said three sides of the sign holder that is 2X in width and an entrance to the slot along said fourth side between the outer wall, inner wall and internal wall of each frame-half that is 2X in width, the permanent graphics panel is within the slot and the distance 2Y is at least equal to the thickness of the graphics panel to locate the panel along a centerline of the slot, and the sign holder can hold changeable signs in the slot along each side of the permanent graphics panel.

6. A sign holder according to any one of claims 1, 2 or 3 wherein:

the second frame-half further includes a plurality of spaced second panel locating means along the internal wall thereof, each second panel locating means has a panel-locating surface along the open side of the second frame-half that extends a selected distance beyond the end surface of the outer wall, and the permanent graphics panel includes marginal portions that surround the first panel-locating means of the two frame-halves and other marginal portions along the panel-locating surface of each second panel locating means to position the graphics panel offset from a centerline of the sign holder.

7. A sign holder according to any one of claims 1, 2 or 3, wherein:

each frame-half has four sides, the end surface of the outer wall of each frame-half extends a selected distance X beyond the end surface of the inner and internal walls along three sides and is coplanar therewith along a fourth side of the sign holder, the sign holder with the first and second frame-halves joined together includes a peripheral inner slot between the inner wall and the internal wall of each frame-half along said three sides of the sign holder that is 2X in width and an entrance to the slot along said fourth side between the outer wall, inner wall and internal wall of each frame-half that is 2X in width, the second frame-half further includes a plurality of spaced second panel locating means along the internal wall about said three sides, each second panel locating means has a panel-locating surface along the open side of the second frame-half that extends a selected distance Z beyond the end surface of the outer wall, the permanent graphics panel includes marginal portions that surround the first panel-locating means of the two frame-halves and other marginal portions along the panel-locating surface of each second panel locating means to position the graphics panel offset from the centerline of the sign holder, and the distance Z is greater than the distance X such that the sign holder can hold a changeable sign in the slot along one side of the permanent graphics panel.

8. A sign holder comprising, in combination:

(1) a first frame-half of molded plastic including (a) a peripheral outer wall and a peripheral inner wall defining a frame-half having a generally U-shaped section with a contiguous exterior wall and an open side, (b) an internal wall extending about the frame-half between the outer wall and the inner wall, (c) the outer wall, inner wall and internal wall each including an end surface along the open side of the frame-half, (d) a plurality of spaced panel locating means along the internal wall having a panel-locating surface extending beyond the end surface of the internal wall, (e) panel locking means including sockets and locking pins extending from the internal wall;

(2) a second frame-half of the same structure as the first frame-half;

(3) a permanent graphics panel between the first frame-half and second frame-half joined together with the locking pins of one frame-half retained in sockets of the other frame-half registered therewith and with the panel locating means of the two frame-halfs locating the permanent graphics panel along a centerline of the frame.

9. The sign holder according to claim 8 wherein:

the panel locating means of the two frame-halfs locate the permanent graphics panel substantially at the centerline of the frame.

10. The sign holder according to claim 9 wherein:

the permanent graphics panel has openings for placement around the locking means.

* * * * *

UNITED STATES PATENT AND TRADEMARK OFFICE

CERTIFICATE OF CORRECTION

PATENT NO. : 5,134,794

DATED : August 4, 1992

INVENTOR(S) : John E. Walrath

It is certified that error appears in the above-identified patent and that said Letters Patent is hereby corrected as shown below:

| | |
|---|---|
| Column 1, line 49 | before "to" "a" should read --as--. |
| Column 3, line 31 | after "frame" a -- - -- should be added. |
| Claim 1<br>Column 8, line 48 | before "together "jointed" should read --joined--. |

Signed and Sealed this

Twenty-eighth Day of September, 1993

Bruce Lehman

*Attest:*

BRUCE LEHMAN

*Attesting Officer*

*Commissioner of Patents and Trademarks*